US007412771B2

(12) United States Patent
Bradley et al.

(10) Patent No.: US 7,412,771 B2
(45) Date of Patent: Aug. 19, 2008

(54) PENDULUM BOW SIGHT

(75) Inventors: John K. Bradley, Register, GA (US); Brian T. Bowen, Brooklet, GA (US)

(73) Assignee: Bradbow, Inc., Savannah, GA (US)

( * ) Notice: Subject to any disclaimer, the term of this patent is extended or adjusted under 35 U.S.C. 154(b) by 48 days.

(21) Appl. No.: 11/498,744

(22) Filed: Aug. 4, 2006

(65) Prior Publication Data

US 2007/0028467 A1 Feb. 8, 2007

Related U.S. Application Data

(60) Provisional application No. 60/705,493, filed on Aug. 5, 2005, provisional application No. 60/757,882, filed on Jan. 11, 2006.

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS

| | | | | |
|---|---|---|---|---|
| 2,351,103 | A | 6/1944 | Brown | |
| 3,013,336 | A | 12/1961 | Pennington | |
| 3,227,035 | A | 1/1966 | Maillard | |
| 3,997,974 | A | 12/1976 | Larson | |
| 4,367,949 | A | 1/1983 | Lavering | |
| 4,711,036 | A | 12/1987 | Morris | |
| 4,796,364 | A | 1/1989 | Amacker | |
| 5,099,819 | A | 3/1992 | Simonds et al. | |
| 5,161,310 | A | 11/1992 | Stoot | |
| 5,320,083 | A | 6/1994 | Brelsford | |
| 5,339,227 | A | 8/1994 | Jones | |
| 5,384,966 | A * | 1/1995 | Gibbs | 33/265 |
| 5,394,615 | A | 3/1995 | Hoppe et al. | |
| 5,634,278 | A | 6/1997 | London | |

(Continued)

FOREIGN PATENT DOCUMENTS

GB 2 249 034 A 4/1992

(Continued)

OTHER PUBLICATIONS http://www.kellerbowsights.com/productsSights.html "Keller Pendulum Bow Sight" Retrieved on Jun. 9, 2005.

(Continued)

*Primary Examiner*—G. Bradley Bennett
(74) *Attorney, Agent, or Firm*—Richard C. Litman

(57) ABSTRACT

The pendulum bow sight is a sight apparatus for an archery bow that provides a luminescent sighting element disposed without the use of supporting pins in a field of view of an optic lens without obstructing the field of view used for sighting a target. The sight apparatus provides unobstructed viewing through a pendulum sight regardless of a bow elevation angle. The pendulum sight has a pivoting lens assembly, which is suspended by a supporting structure capable of being mounted to e.g., the riser of a bow. The bow sight lens assembly is freely rotatable about a pivot axis disposed across a region encompassed by the supporting structure. The pendulum bow sight provides independent horizontal and vertical adjustments of the sighting element for calibration that is good for up to thirty-five yards, and with any bow elevation angle.

15 Claims, 7 Drawing Sheets

U.S. PATENT DOCUMENTS

| | | | | |
|---|---|---|---|---|
| 5,836,294 | A | 11/1998 | Merritt | |
| D406,630 | S | 3/1999 | Emerson | |
| D408,491 | S | 4/1999 | Savage | |
| 5,996,569 | A | 12/1999 | Wilson | |
| 6,145,208 | A | 11/2000 | Savage | |
| 6,321,479 | B1 | 11/2001 | Sheehan | |
| 6,446,347 | B1 * | 9/2002 | Springer | 33/265 |
| 6,453,898 | B1 * | 9/2002 | Altmann et al. | 124/87 |
| 6,477,778 | B1 * | 11/2002 | Lorocco | 33/265 |
| 6,557,291 | B2 | 5/2003 | Hoadley | |
| 6,725,854 | B1 | 4/2004 | Afshari | |
| 6,745,482 | B1 | 6/2004 | Mallozzi | |
| 6,802,131 | B1 * | 10/2004 | Scholz et al. | 33/293 |
| 6,862,813 | B1 | 3/2005 | Chen et al. | |
| 2002/0062569 | A1 * | 5/2002 | Slates | 33/265 |
| 2002/0073559 | A1 | 6/2002 | Johnson | |
| 2003/0056379 | A1 * | 3/2003 | Johnson et al. | 33/265 |
| 2004/0088872 | A1 | 5/2004 | Deien | |

FOREIGN PATENT DOCUMENTS

| | | |
|---|---|---|
| WO | WO 2004/094934 | 11/2004 |

OTHER PUBLICATIONS http://www.fastestbows.com/reviews/peep_eliminator_compound_bow_sight.htm "Peep Eliminator: Compound Bow Rifle Alignment Sight" Retrieved on Jun. 9, 2005.

http://www.timberline-archery.com/np.asp "No Peep-Timberline Archery Products" Retrieved on Jun. 9, 2005.

* cited by examiner

PENDULUM BOW SIGHT

CROSS-REFERENCE TO RELATED APPLICATION

This application claims the benefit of U.S. Provisional Patent Application Ser. No. 60/705,493, filed Aug. 5, 2005. Additionally, this application claims the benefit of U.S. Provisional Patent Application Ser. No. 60/757,882, filed Jan. 11, 2006.

BACKGROUND OF THE INVENTION

1. Field of the Invention

The present invention relates to sighting devices for use with an archery bow, and more particularly to an archery pendulum bow sight that provides a sighting element configured for an unobstructed view of the target in a sighting field of view.

2. Description of the Related Art

Users of archery bow and arrow systems for hunting usually must deal with several problems to consistently kill prey. The problems include focusing on the prey through a sighting element in order to position the bow to shoot at the target. Bow sights are normally used on the bow to aid the hunter in properly aiming the arrow at the intended target. However, many bow sights fall short of the ideal in that they often obscure some part of the target because the sighting elements employed have too much width or length.

Horizontal sight pins spaced apart from each other are a common type of sight apparatus where each of the pins represents a particular distance. Thus, an arrow is properly aimed at a target when a distance to the target is known and the corresponding pin is aligned with the target. Use of the correct sight pin relies on a hunter accurately estimating the exact distance to the target. Moreover, the more pins used as sighting elements, the more chances that a potential target will be obscured by one or more of the pins.

While these particular devices have met with some success, problems have been encountered with the use of pins for sighting elements.

Since a hunter often only has one chance to take down the quarry, the hunter should be able to view through a sighting element that clearly frames the target without any obstructing pins and the like. The capability to view the target in an unobstructed manner is especially problematic on hilly terrain, or when there is an elevation difference between hunter and the hunted.

When the hunter and her target are not in the same horizontal plane, e.g., when the hunter is positioned in a tree stand or on a hillside, a pendulum sight is usually the sighting mechanism of choice. Conventional pendulum sights have been limited due to the fact that often sighting pins used in the pendulum obscure at least some portion of the target. When shooting from an elevated position utilizing a pendulum sight, it would be highly desirable to have an unobstructed field of view within the pendulum sighting device.

Thus an improved pendulum bow sight solving the aforementioned problems is desired.

SUMMARY OF THE INVENTION

The pendulum bow sight is a sight apparatus for an archery bow that provides a luminescent sighting element disposed within a field of view of an optic lens without obstructing the field of view used for sighting a target. The sight apparatus provides unobstructed viewing through a pendulum sight regardless of a bow elevation angle. The pendulum sight has a pivoting lens assembly, which is suspended by a supporting structure capable of being mounted to e.g., the riser of a bow. The bow sight lens assembly is freely rotatable about a pivot axis disposed across a region encompassed by the supporting structure. The pendulum bow sight provides independent horizontal and vertical adjustments of the sighting element for calibration that is good for up to thirty-five yards, and with any bow elevation angle.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
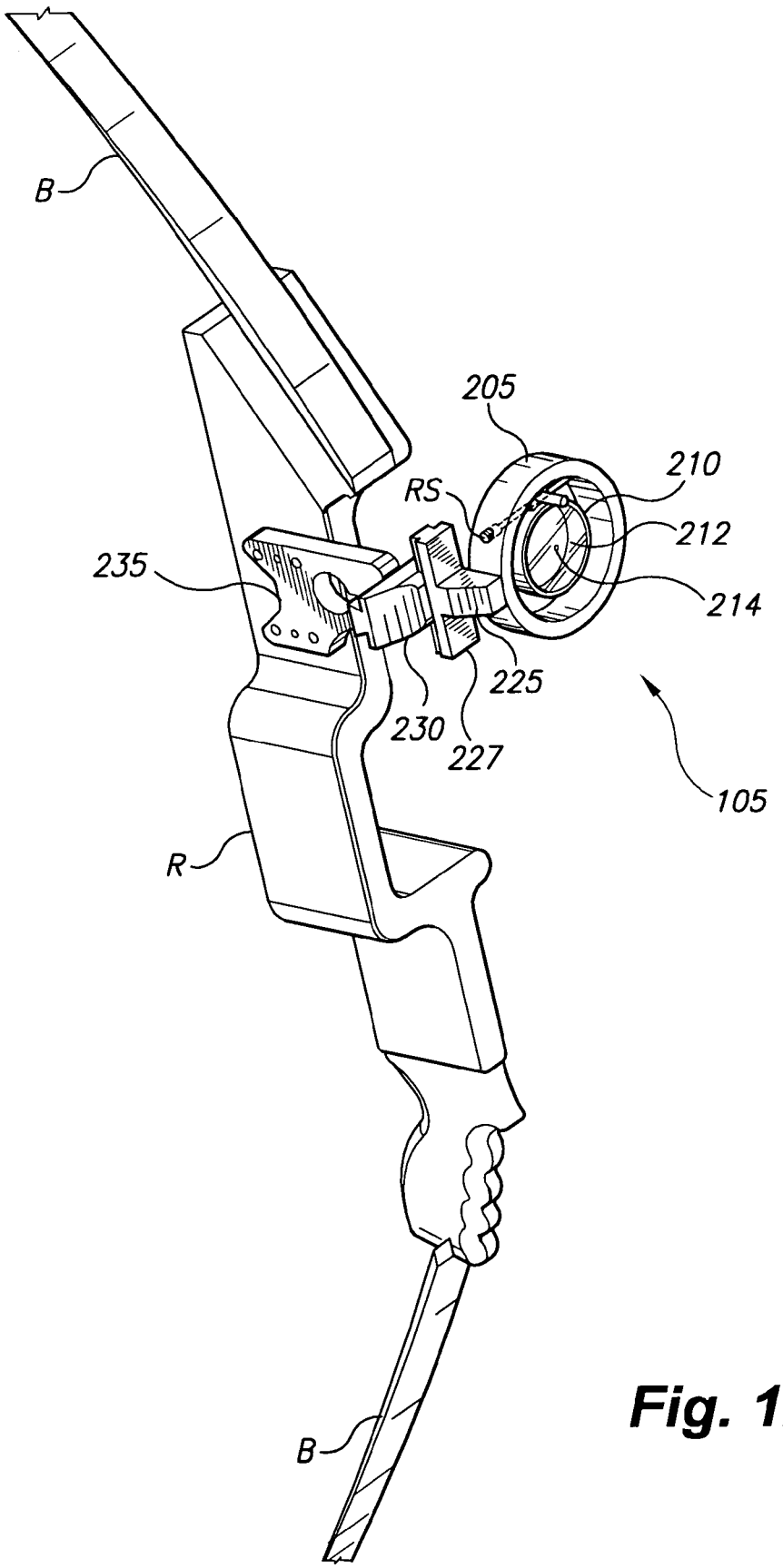
FIG. 1A is an environmental perspective view of the pendulum bow sight according to the present invention.

The present invention is a pendulum bow sight 105 capable of being mounted to a riser R of an archery bow B, as shown in FIG. 1A. The pendulum bow sight 105 includes a sight apparatus for an archery bow that provides a luminescent sighting element 214 disposed within a field of view of an optic lens 212 so that the field of view used for sighting a target is not obstructed.

The pendulum bow sight 105 provides the unobstructed view through the lens 212 regardless of a bow elevation angle. As shown in FIG. 1A, a lens assembly of the pendulum sight 105 comprises lens frame 210 and optical lens 212. It is also within the scope of the present invention to provide a frameless lens assembly. The luminescent sighting element 214 may be encapsulated in, or otherwise fixed to the center or other appropriate region of optic lens 212 so that it does not require a supporting pin. In other words, luminescent sighting element 214 is supported by the lens 212 and appears as a target sighting aid in the field of view of lens 212.

Additionally, while a single lens 212 is shown in FIG. 1A, it is also within the scope of the present invention to provide the luminescent sighting element 214 in the field of view of a compound lens assembly comprising more than one lens. Moreover, the luminescent sighting element 214 may, without the use of supporting pins, be embedded or projected in the center or other appropriate viewing region of the lens 212 by any other means that provides a clear, unobstructed view through the lens 212. Lens 212 or compound lens (not shown) may be of a variety of optical configurations to provide a desired magnification factor and field of view width. For example, a particular embodiment of the present invention includes a lens 212 that has one concave surface and an opposing relatively flat surface so that a hunter's field of view is increased when sighting through the bow sight lens 212. Preferably the lens 212 is composed of a clear, non-reflective material, e.g., glass, poly-carbonate, and the like, of suitable optical quality.

The lens assembly is suspended by a supporting structure capable of being mounted to e.g., the riser R of a bow such as bow B. The lens assembly suspension from the supporting structure provides a pivot axis disposed across a region encompassed by the supporting structure so that the bow sight lens assembly is freely rotatable about the pivot axis.

Figure 1B:
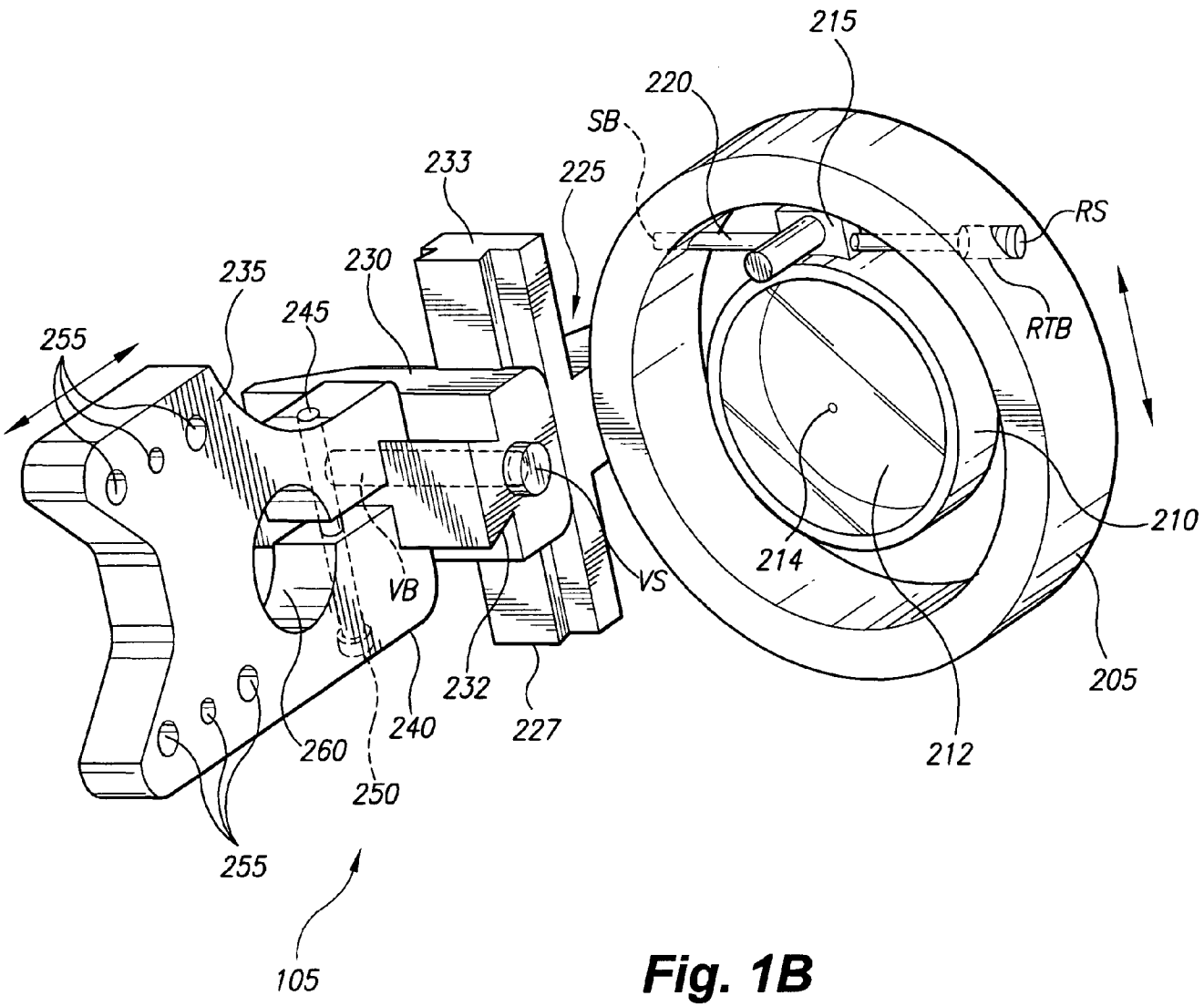
FIG. 1B is a perspective view of the pendulum bow sight according to the present invention.

As shown in FIG. 1B, the luminescent element 214 may be in the shape of a dot, and may be composed of captured gaseous tritium, or a pigmented compound containing tritium or other similar luminescent formulation. Additionally, the luminescent element 214 may form a reticle comprising any suitable predetermined shape or pattern, such as crosshairs, grids, bulls-eyes, and the like. Advantageously, for most applications, the luminescent element 214 is capable of glowing without the use of an external power supply, although the use of electro luminescent material is also contemplated by the present invention. Additionally, although not supported by pins, the luminescent element 214 may comprise a pin or plurality of pins mounted through or parallel to an axial centerline of the lens 212 in a pattern to form the reticle while at the same time minimizing obstruction to the field of view through the lens 212.

Figure 1C:
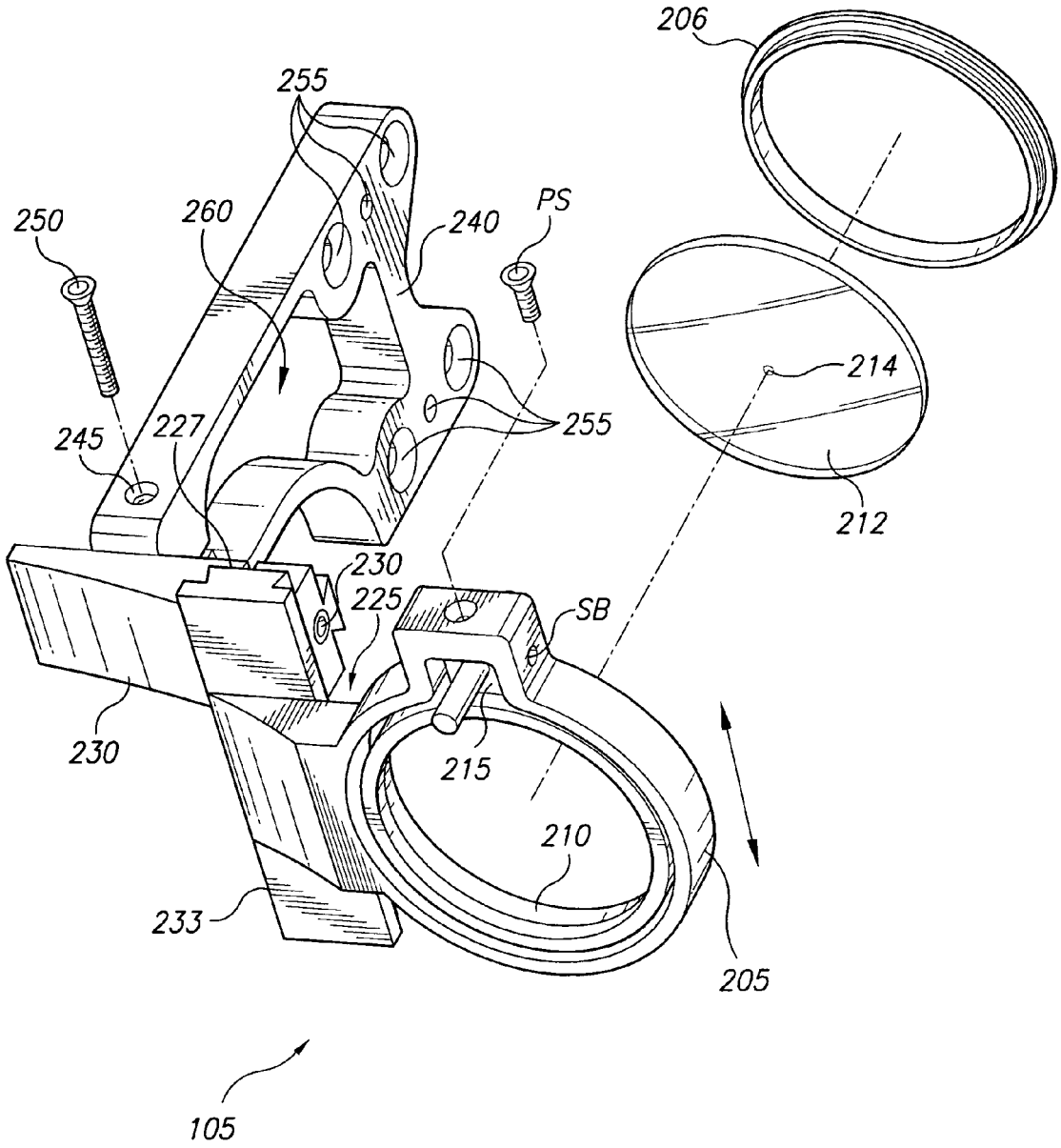
FIG. 1C is a perspective view of an alternative embodiment of the pendulum bow sight according to the present invention.
Figure 2:
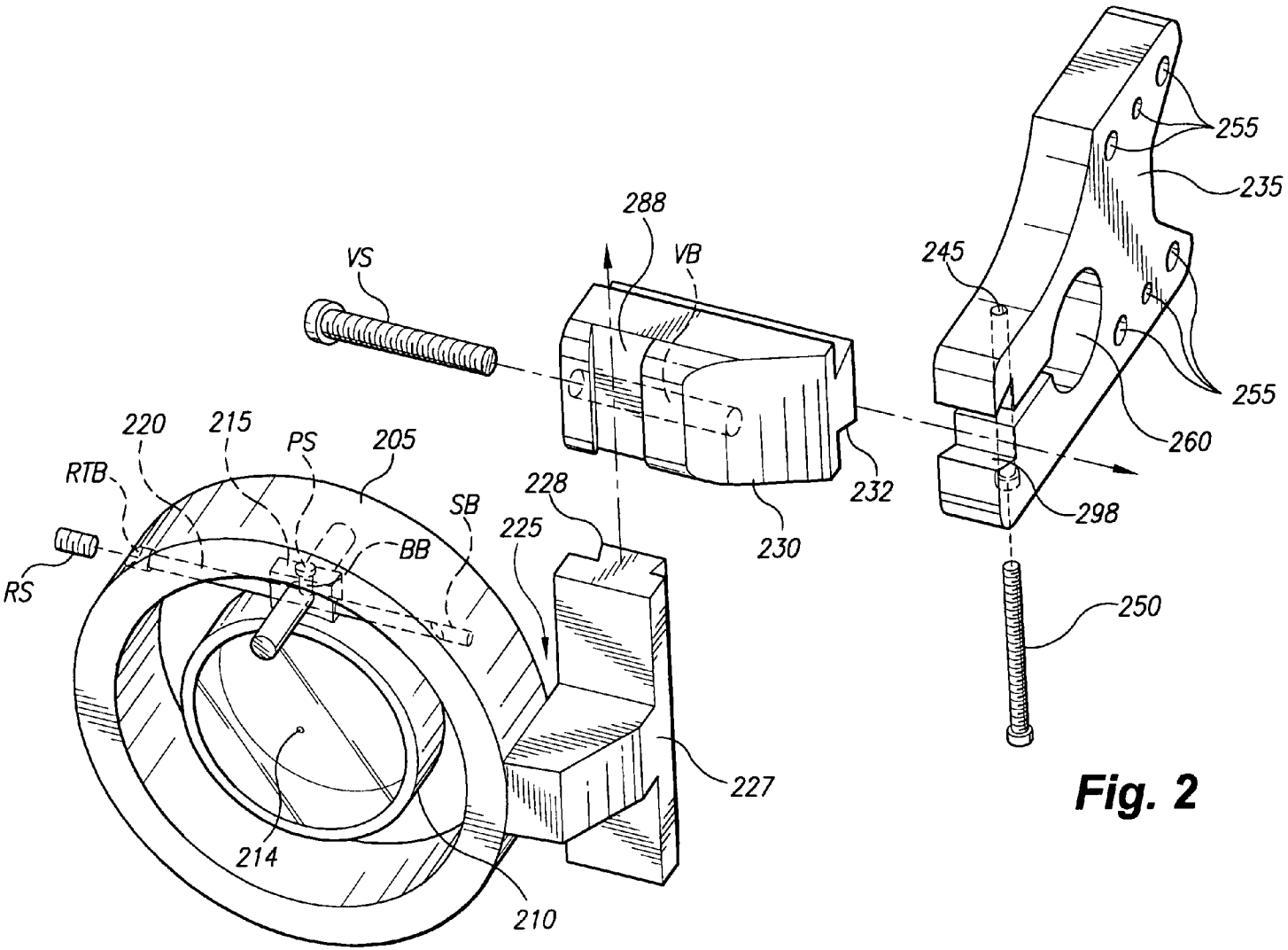
FIG. 2 is an exploded perspective view of the pendulum bow sight according to the present invention.

In the embodiment shown in FIGS. 1B and 2, the optical lens 212 is framed by lens frame 210. While as shown, both lens 212 and lens frame 210 are substantially cylindrical, other lens and frame shapes are contemplated by the present invention. Moreover, the lens frame 210 may be constructed so that lens 212 is removably attached to the lens frame 210 in order to provide ease of lens interchangeability and replacement. For example as shown in FIG. 1C, threaded lens retaining ring 206 threads into the frame body 210 to retain cylindrical lens 212 during use. When a hunter wishes to remove the lens 212, he/she unthreads the retaining ring 206 from the frame body 210 to free the lens 212. Other means of lens retention and removal are contemplated, such as a snap fit to the frame. Frameless lenses may be removed and replaced by merely disengaging the lens 212 from the supporting structure suspension means.

As shown in FIGS. 1B and 1C the lens assembly comprising the frame 210 and lens 212 is suspended from a supporting structure, i.e., an outer cylinder 205, which is ultimately connected to a bow-mounting bracket 235. As shown in FIG. 1B, the bow-mounting bracket 235 has a mounting bracket aperture 260. As shown in FIG. 1C, the mounting bracket aperture may be of wider dimension than the aperture 260 shown in FIG. 1B. The wider dimensioned aperture 260 of the mounting bracket shown in FIG. 1C advantageously provides a bow sight 205 that is of lighter weight without compromising the mounting bracket strength.

As shown in FIGS. 1B and 2, the bow sight lens assembly comprising lens frame 210 and lens 212 has a very low friction pivotal connection comprised of pendulum attachment pivot rod 220, and pendulum attachment boss 215 of lens frame 210.

The lens assembly is permitted to freely rotate about a pivot axis defined by attachment pivot rod 220 running, i.e., extending through pendulum attachment boss 215, and disposed across a region encompassed by the outer cylinder 205. The very low friction pivotal connection of attachment pivot rod 220 extending through pendulum attachment boss 215 allows the lens assembly to rotate freely about the pivot axis in order to remain in a plumb position regardless of an elevation angle of the bow.

Figure 5:
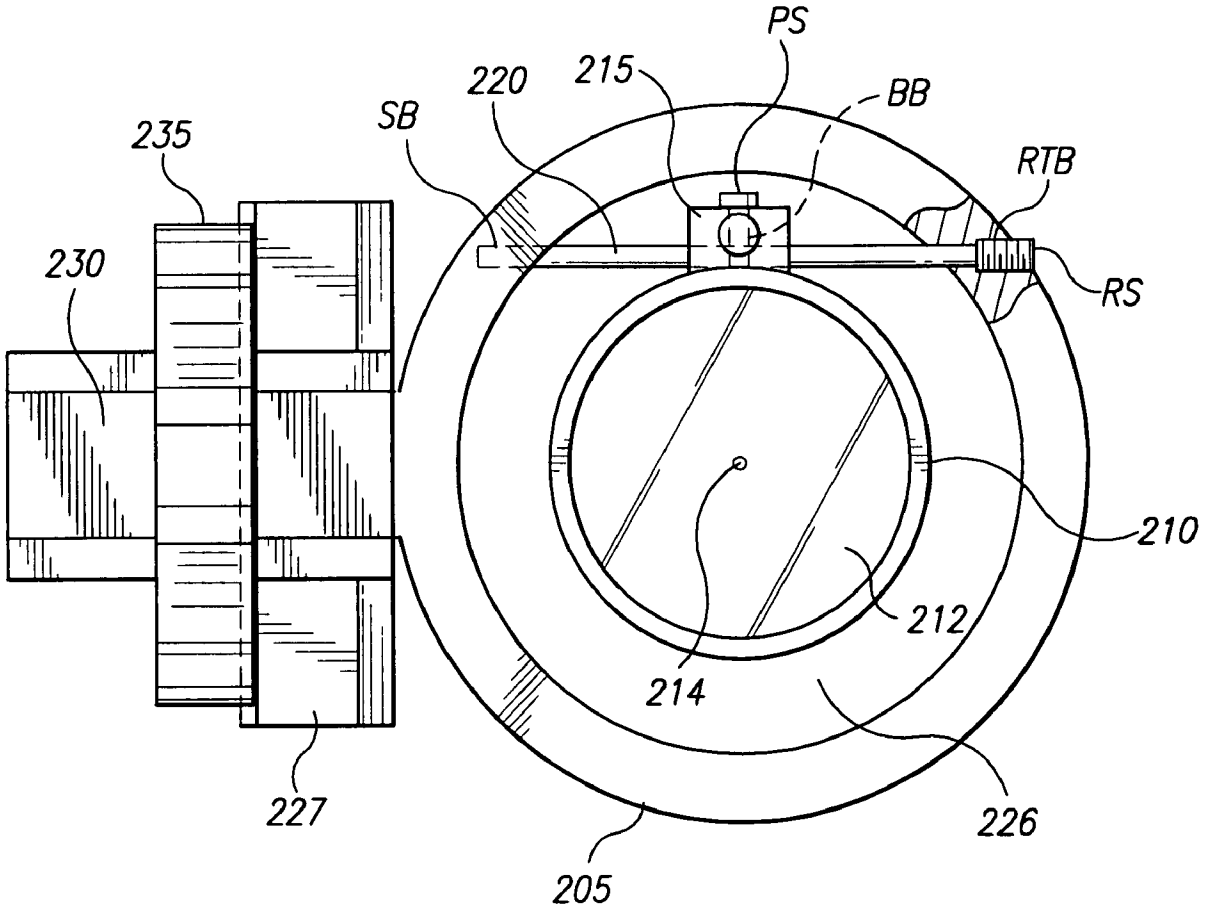
FIG. 5 is a rear view of the outer cylindrical member attached to the cylindrical sighting member of a pendulum bow sight according to the present invention.

As shown in FIG. 2, pendulum attachment balancing boss 215 is rigidly connected to a top of the lens frame 210 and has a laterally oriented axial through-bore through which the attachment pivot rod 220 passes. In addition, as most clearly shown in FIG. 5, at the top of pendulum attachment boss 215 is situated a bore BB through which an adjustable member, such as pendulum set screw PS threads and can be tightened to perpendicularly engage pivot rod 220 in order to inhibit pendulum action of the lens assembly when the hunter desires to use the bow sight 105 in a conventional fixed manner.

Figure 3:
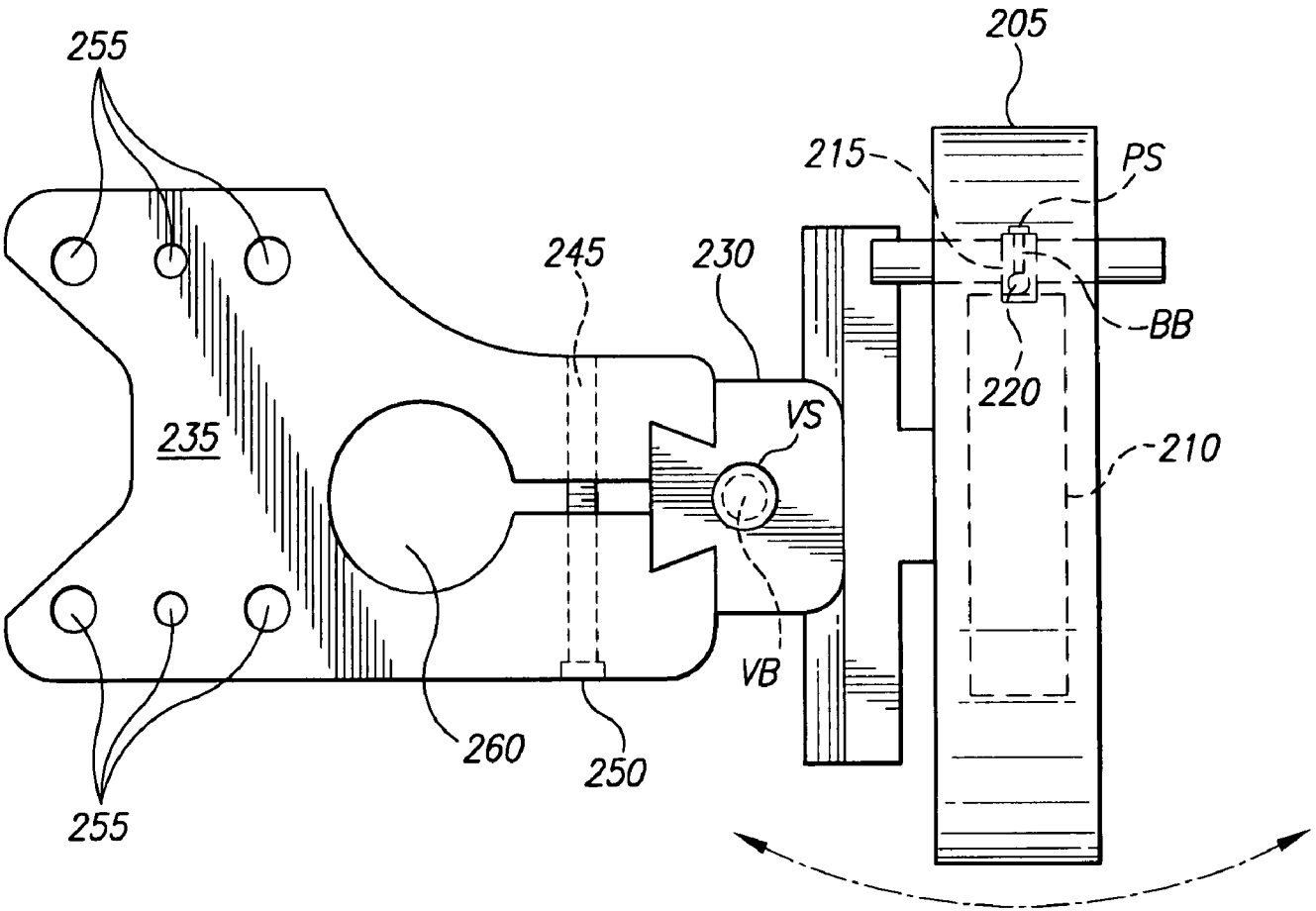
FIG. 3 is a side plan view of the mounting bracket and horizontal adjustment bar of a pendulum bow sight according to the present invention.

The pivot rod 220 is secured to outer cylinder 205 by being supported in a support bore SB on a side of the outer cylinder 205. The pivot rod 220 is secured laterally by pivot rod set screw RS, which is threaded into a threaded bore RTB in an opposing side of the outer cylinder 205. FIG. 3 indicates how the pivot rod attachments at SB and at RTB allow the lens assembly to freely rotate about the pivot rod 220 with respect to any angular displacement of the outer cylinder 205 from a vertical plane, thus allowing the lens assembly to remain plumb. Alternatively, the pivot rod 220 may be held in place across a region encompassed by the outer cylinder 205 by means of a compression fitting through one of the supporting bores such as support bore SB.

As shown in FIG. 1C, the pivot rod 220 may attach to the outer cylinder 205 in an upper region of the outer cylinder 205, such as the region defined by pivot rod receiving aperture 222. In a particular embodiment, the outer cylinder 205 may be concentric with the lens frame 210. It should be noted, however, that the supporting structure and lens assembly are not restricted to cylindrical embodiments, may not be concentric, and may be of various non-cylindrical geometries. Moreover, the shape of the lens assembly does not necessarily have to match the shape of the supporting structure.

As shown in FIG. 1B, outer cylinder 205 is connected to sight attachment member 225, a substantially narrow member of sufficiently vertical length to provide adequate vertical adjustment of the lens assembly. The sight attachment member 225 has a vertical slide rail 227, which is used for making vertical adjustments to the lens assembly of the pendulum bow sight 105. Additionally, as shown in FIG. 1C, the connection of outer cylinder 205 to sight attachment member 225 may be contoured to provide an esthetically pleasing appearance to the bow sight 105.

The vertical slide rail 227 may be formed by chamfering a vertical section of sight attachment member 225, thus resulting in a chamfered edge, such as chamfered edge 228 of sight attachment member 225, which is shown in FIG. 2.

Referring back to FIG. 1A, the attachment of the outer cylinder 205 to sight attachment member 225 is made in such a way as to insure that outer cylinder 205 and the lens assembly nominally lie in a plane that is perpendicular to a plane defined by a side view of bow mounting bracket 235 when the outer cylinder 205 and lens frame 210 are attached to the bracket 235.

The pendulum bow sight provides independent horizontal and vertical adjustments of the sighting element for calibration that is good for up to thirty-five yards with any bow elevation angle. Thus, as shown in FIG. 1B and FIG. 2, a vertical slide rail 227 comprising a chamfered edge 228 disposed on a rear vertical section 233 of sight attachment member 225 provides for vertical adjustment of the bow sight outer cylinder 205 and lens frame 210 when the vertical slide rail 227 is slid into a vertically oriented receiving slot 288 on front of horizontal attachment member 230.

A vertical adjustment is made by loosening vertical adjustment screw VS and sliding the outer cylinder 205 and lens frame 210 up or down as desired, then tightening vertical adjustment screw VS to secure the desired position of the lens assembly. Vertical adjustment screw VS threads through vertical adjustment bore VB, which is directed through horizontal attachment member 230.

Figure 4:
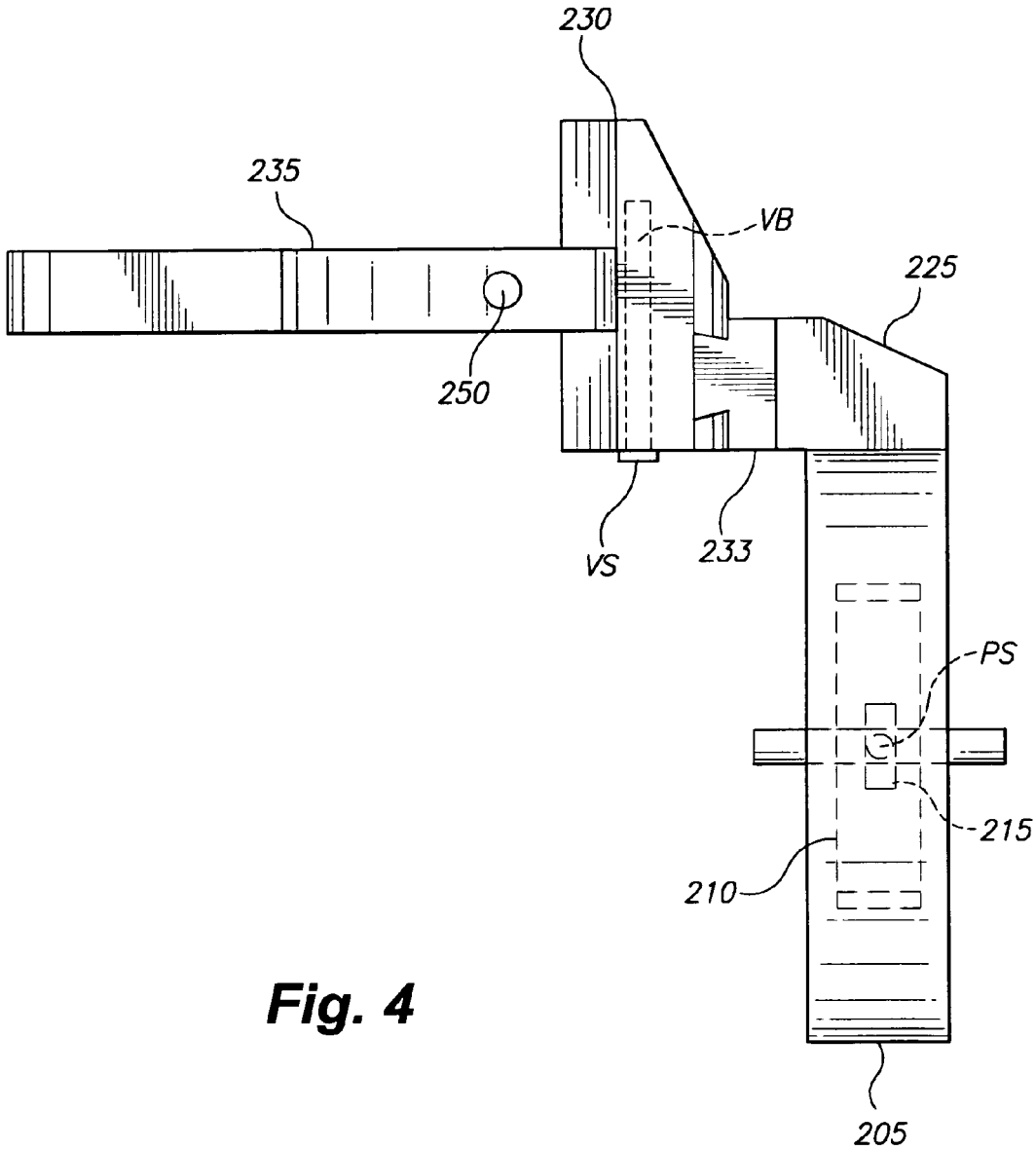
FIG. 4 is a top plan view of the pendulum bow sight according to the present invention.

As shown in FIG. 4, vertical adjustment bore VB is drilled along a plane parallel to a rear face of horizontal attachment member 230. However, the drilling is behind vertical adjustment slot of the horizontal attachment member 230. Vertical adjustment screw VS never touches any part of vertical section 233 of sight attachment member 225. As shown in FIG. 1B, a clamping effect of vertical slide rail 227 to horizontal attachment member 230 is achieved by a slight compressive force within horizontal attachment member 230 as the vertical adjustment screw VS is tightened. Because vertical adjustment screw VS does not come into contact with vertical slide rail 227, wear and tear on the vertical slide rail 227 is reduced.

Horizontal adjustment of the bow sight lens assembly is accomplished by providing a horizontal slide rail 232 disposed on horizontal attachment member 230. Referring to FIG. 2, when horizontal slide rail 232 of horizontal attachment member 230 slides into horizontal receiving slot 298 of mounting bracket 235, a desired horizontal position of the bow sight may be secured by tightening setscrew 250 through bore 245 of bow mounting bracket 235, thus clamping horizontal attachment member 230.

Once calibrated, the pendulum bow sight 105, as shown in FIG. 1A, may be used at various elevational distances between a hunter and his prey. Thus a pendulum bow sight 105 that provides independent horizontal and vertical adjustments of the sighting element for calibration that is good for up to thirty-five yards, and with any bow elevation angle has been described.

It is to be understood that the present invention is not limited to the embodiments described above, but encompasses any and all embodiments within the scope of the following claims.

We claim:

1. A pendulum bow sight, comprising:

a supporting structure for suspending a bow sight lens assembly;

the bow sight lens assembly including a bow sight lens;

the bow sight lens assembly being freely rotatable about a pivot axis disposed across a region encompassed by the supporting structure;

a pendulum bow sight mount for mounting the pendulum bow sight on a bow;

a luminescent sighting element disposed without the use of supporting pins in a field of view of the bow sight lens so that the luminescent sighting element provides an aid for sighting targets without obstructing the field of view when the bow is aimed at the targets at various elevations;

a horizontal slide rail being slidably disposed on the bow mount to provide for horizontal calibration adjustment of the bow sight; and, a vertical slide rail being disposed on a sight attachment member of the supporting structure to provide for vertical calibration adjustment of the bow sight.

2. The pendulum bow sight according to claim 1, wherein the luminescent sighting element is encapsulated in the bow sight lens.

3. The pendulum bow sight according to claim 2, wherein the luminescent sighting element is a pigmented compound containing a luminescent formulation.

4. The pendulum bow sight according to claim 1, wherein the luminescent sighting element is comprised of tritium.

5. The pendulum bow sight according to claim 4, wherein the tritium is in a captured gaseous state.

6. The pendulum bow sight according to claim 1, wherein the luminescent element comprises a shape of a dot.

7. The pendulum bow sight according to claim 1, wherein the luminescent element forms a reticle comprising a predetermined pattern.

8. The pendulum bow sight according to claim 1, wherein the luminescent element is capable of glowing without the use of an external power supply.

9. The pendulum bow sight according to claim 1, wherein the luminescent element comprises electro luminescent material.

10. The pendulum bow sight according to claim 1, wherein the bow sight lens is surrounded by a lens frame.

11. The pendulum bow sight according to claim 10, wherein the bow sight lens is capable of being removably attached to the lens frame in order to provide ease of lens interchangeability and replacement.

12. The pendulum bow sight according to claim 1, wherein the bow sight lens is pivotably suspended from the supporting structure to permit free rotation about a pivot axis suspending the lens and extending through an area encompassed by the supporting structure.

13. The pendulum bow sight according to claim 12, wherein an adjustable member can engage a pivot member perpendicular to the pivot axis of the pivot member to inhibit pendulum action of the bow sight lens when a user desires to use the bow sight in a conventional fixed manner.

14. The pendulum bow sight according to claim 1, wherein the horizontal and vertical calibration adjustments are independent of each other.

15. The pendulum bow sight according to claim 1, wherein the bow sight lens is composed of a clear, non-reflective material of suitable optical quality.

* * * * *